US005659297A

United States Patent [19]

Tatavoosian

[11] Patent Number: 5,659,297

[45] Date of Patent: Aug. 19, 1997

[54] DISPLAY SYSTEM

[75] Inventor: Vanacan Tatavoosian, Mission Vejo, Calif.

[73] Assignee: Eaton Corporation, Cleveland, Ohio

[21] Appl. No.: 410,872

[22] Filed: Mar. 27, 1995

[51] Int. Cl.[6] ..... G08B 5/00

[52] U.S. Cl. ..... 340/815.4; 340/815.47; 340/815.48; 340/815.49; 340/815.73; 340/815.74; 200/310; 200/313; 200/314; 200/317

[58] Field of Search ..... 340/815.4, 815.47, 340/815.48, 815.49, 815.73, 815.74, 815.75, 815.76; 200/308, 310, 311–315, 316, 317, DIG. 36

[56] References Cited

U.S. PATENT DOCUMENTS

| | | | |
|---|---|---|---|
| 3,573,814 | 4/1971 | Lang . | |
| 3,581,307 | 5/1971 | McKim et al. . | |
| 3,660,713 | 5/1972 | Leslie et al. | 313/318 |
| 4,106,231 | 8/1978 | MacNiel | 40/547 |
| 4,430,691 | 2/1984 | Rea | 361/383 |
| 4,472,610 | 9/1984 | Fuller et al. | 200/339 |
| 5,295,050 | 3/1994 | Helstern et al. | 340/815.42 |
| 5,550,342 | 8/1996 | Danek et al. | 200/448 |

OTHER PUBLICATIONS

*A Practical Design Check List for NVIS Compatible Lighting*, Presented to: Aerospace Lighting Institute, Advanced School/Seminar, Los Angeles, California, Feb., 1994, by Van Tatavoosian, Product Engineering Manager, Optics and Display Technology, Eaton Corporation.

*Primary Examiner*—Donnie L. Crosland
*Attorney, Agent, or Firm*—Tarolli, Sundheim, Covell, Tummino & Szabo

[57] ABSTRACT

A pushbutton of a switch assembly has an improved display system which includes a housing formed of an electrically insulating polymeric material. A solid-state display system is disposed within the housing. The solid-state display system includes an array of light emitting diodes mounted on a circuit board. The circuit board is disposed on a metal heat sink. The heat sink positions the circuit board relative to the display housing and receives heat from the light emitting diodes. In addition, the heat sink forms a portion of a circuit which conducts electrical energy to energize the light emitting diodes.

34 Claims, 6 Drawing Sheets

DISPLAY SYSTEM

BACKGROUND OF THE INVENTION

The present invention relates to an improved display system to provide information to an observer.

Display systems are commonly utilized in aircraft to provide information to a pilot of the aircraft. When the aircraft is parked on the ground, the aircraft may be at a relatively low or relatively high temperature. Immediately prior to flight, the temperature of the interior of the aircraft is quickly changed to be comfortable for an occupant of the aircraft. This results in the components of the display system in the aircraft being subjected to a relatively wide range of temperatures within a short period of time.

In order to determine whether or not a display system can withstand thermal stresses resulting from repeated exposure to this wide range of temperatures, the display system may be subjected to a temperature test. The temperature test includes a plurality of test cycles during which the temperature of the display system is changed in a range which varies from −55° C. to +85° C. During each test cycle, the display system is electrically energized at various temperatures.

If a display system can withstand 19 cycles of the temperature test without failure, the display system may be judged to be satisfactory for use in a specific aircraft. A known display system includes six light emitting diodes which are disposed on a ceramic support. When a plurality of these display systems were subjected to the temperature test, most of the display systems failed after they had been subjected to between five and sixteen cycles of the temperature test. It is interesting to note that 350 cycles of the temperature test may be considered to exceed the thermal stresses encountered during the operating life of a specific aircraft.

SUMMARY OF THE INVENTION

The present invention provides a new and improved display system to provide information to an observer. The improved display system does not fail after being subjected to a temperature test which includes 350 cycles in which the temperature varies from −55° C. to +85° C. During the temperature test, light sources in the display system are energized at various temperatures. The display system may advantageously be used in a pushbutton of a switch assembly.

The display system includes a heat sink. A circuit board is mounted on the heat sink. Light sources are mounted on the circuit board. The light sources are electrically energizeable to produce light which is transmitted to an observer and heat which is transmitted to the heat sink. The light sources may be energized by electrical energy which is conducted through a circuit which includes the heat sink.

The heat sink may have a plurality of wall sections which extend outward from a body portion of the heat sink. The wall sections engage the circuit board to position the circuit board relative to the body portion of the heat sink. The heat sink has a plurality of retaining tabs which engage the circuit board to press the circuit board against the heat sink and to hold the circuit board against movement relative to the heat sink. The retaining tabs may engage conductors on the circuit board to electrically interconnect the heat sink and light sources.

BRIEF DESCRIPTION OF THE DRAWINGS

The foregoing and other features of the present invention will become more apparent upon a consideration of the following description taken in connection with the accompanying drawings, wherein.

DESCRIPTION OF SPECIFIC PREFERRED EMBODIMENTS OF THE INVENTION

General Description

Figure 2:
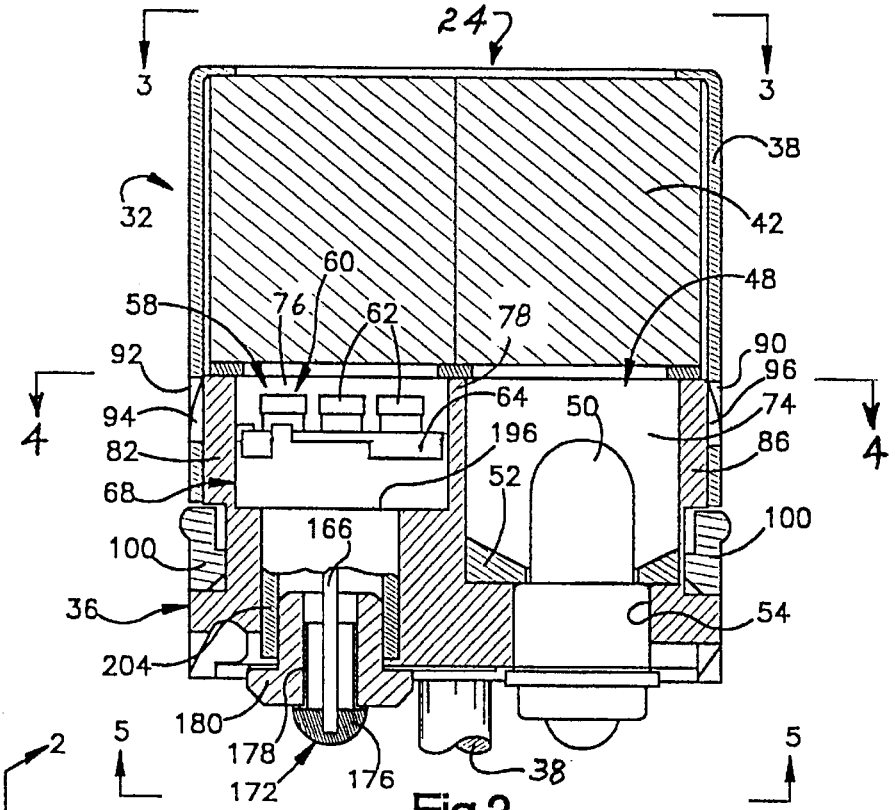
FIG. 2 is a fragmentary sectional view, taken generally along the line 2—2 of FIG. 1, illustrating the construction of the display system.

An improved switch assembly 20 (FIG. 1) includes a rectangular outer housing 22. A pushbutton 24 is manually movable relative to the outer housing 22. Upon manual movement of the pushbutton 24 relative to the outer housing 22, an actuator mechanism, indicated schematically at 26 in FIG. 1, actuates a switch 28 between open and closed conditions. An overall display system 32 in the pushbutton 24 provides information to an observer. The overall display system 32 may be activated independently of actuation of pushbutton 24 or in conjunction with actuation of the pushbutton.

The construction of the switch assembly 20 may be similar to the construction of the switch assembly disclosed in U.S. Pat. No. 5,294,900 issued Mar. 15, 1994 and entitled "Switch Assembly" or may be similar to the construction of the switch assembly disclosed in U.S. Pat. No. 5,296,826 issued Mar. 22, 1994 and entitled "Switch Assembly". The improved overall display system 32 may be used in association with switch assemblies having many different constructions other than the specific construction set forth in the aforementioned U.S. patents. It is contemplated that the overall display system 32 may be used in conjunction with devices other than a switch assembly. For example, the overall display system 32 could be a stationary display system mounted on a suitable support, such as an aircraft instrument panel, to provide information to an observer upon the occurrence of a specific event.

Figure 3:
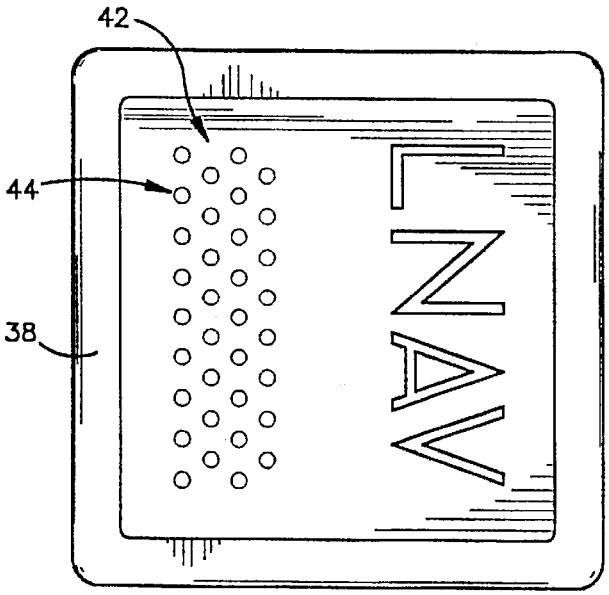
FIG. 3 is a plan view, taken generally along the line 3—3 of FIG. 2, illustrating indicia disposed in the display system to provide information to an observer.

The overall display system 32 (FIG. 2) includes a display housing 36 disposed in the pushbutton 24. An actuator rod 38 extends downward (as viewed in FIG. 2) from the display housing 36 to operate the actuator mechanism 26 (FIG. 1) upon manual actuation of the pushbutton 24. A lens 42 is connected with the display housing 36 by a lens cap 38. The lens 42 contains indicia 44 (FIG. 3). When the indicia is illuminated, it provides information to an observer.

The lens 42 may have many different constructions. However, it is believed that it may be preferred to construct the lens 42 in the manner disclosed in U.S. Pat. No. 5,544,019 issued Aug. 6,1996 to Tatavoosian et al. and entitled "Display System". If desired, the lens 42 could have the construction disclosed in U.S. Pat. No. 5,295,050 issued Mar. 15, 1994 and entitled "Display System".

An incandescent display system 48 (FIGS. 2 and 4) is disposed in the display housing 36. The incandescent display system 48 includes a pair of light sources 50 (only one of which is shown in FIG. 2). The light sources 50 are incandescent electric bulbs which are surrounded by reflectors 52. The incandescent electric bulbs 50 are received in sockets 54 (FIG. 2) in the display housing 36. The bulbs 50 are energizeable to illuminate indicia 44 on the right (as viewed in FIG. 3) half of the lens 42.

In addition, a solid-state display system 58 (FIGS. 2 and 4) is disposed in the display housing 36. The solid-state display system 58 includes an array 60 (FIGS. 2, 4 and 6) of solid state light sources 62. In the illustrated embodiment of the invention, the light sources 62 are light emitting diodes. However, other known light sources could be utilized if desired.

Figure 4:
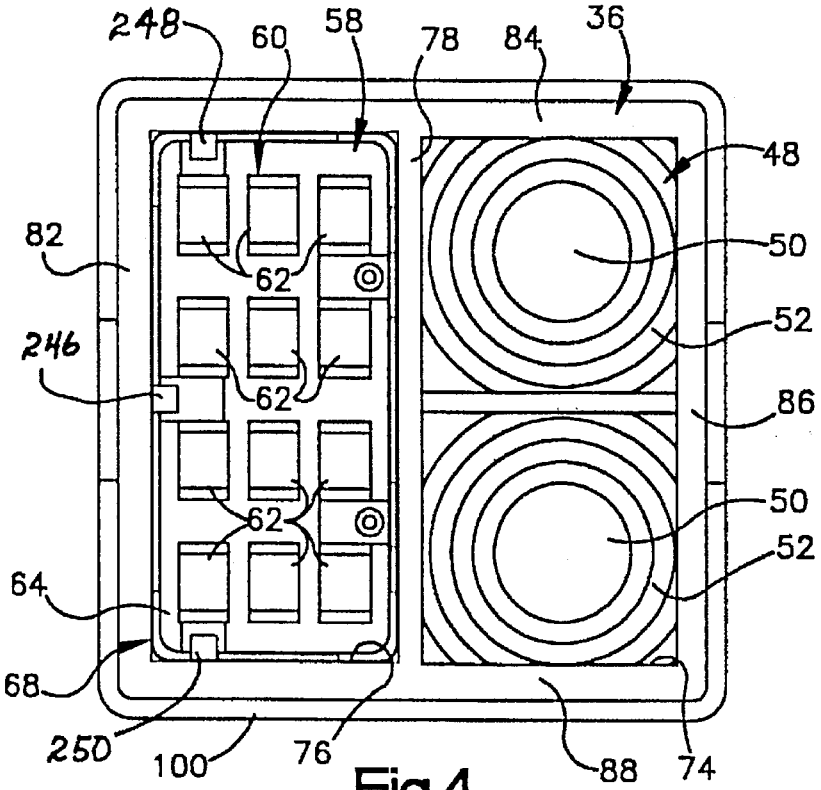
FIG. 4 is a plan view, taken generally along the line 4—4 of FIG. 2, illustrating the display system with portions of the display system removed.
Figure 6:
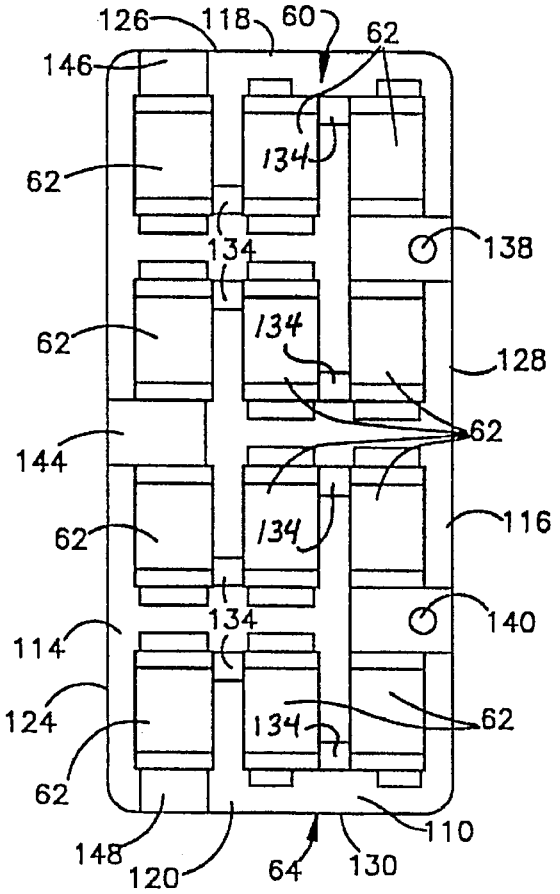
FIG. 6 is an enlarged plan view of a circuit board used in the display system of FIG. 2.

The array 60 of solid state light sources 62 is disposed on a circuit board 64 (FIGS. 2, 4 and 6). Energizing the light sources 62 illuminates the portion of the indicia 44 on the left (as viewed in FIG. 3) portion of the lens 42.

In accordance with one of the features of the present invention, the solid-state display system 58 includes a heat sink 68 (FIG. 2). The heat sink 68 positions the circuit board 64 and array 60 of light sources relative to the display housing 36. The heat sink 68 receives heat from the light sources 62 and circuit board 64 when the light sources are energized. In addition, the heat sink 68 forms a portion of a circuit which conducts electrical energy to energize the light sources 62.

The solid-state display system 58 has a high degree of reliability. Thus, a known display system may function satisfactorily for 2,000 to 5,000 flight hours of an aircraft. It is believed that the solid-state display system 58 will, under normal operating conditions, function satisfactorily for 50,000 or more flight hours of an aircraft.

The high degree of reliability of the solid-state display system 58 is due to a combination of many different features of the display system. Among these features is the use of the heat sink 68 to promote uniformity of temperature in the circuit board 64 and to dissipate heat generated during energization of the light sources 62. In addition, the solid-state display system 58 is relatively small and is not overly susceptible to failure due to exposure to vibration.

Overall Display System

Figure 1:
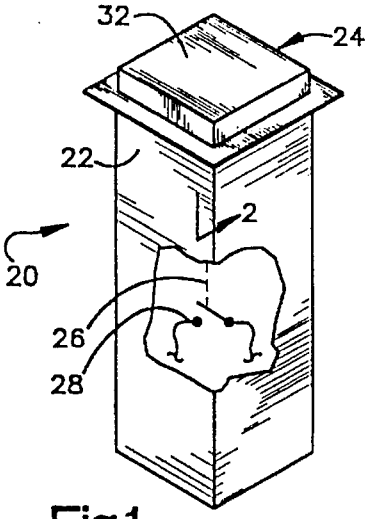
FIG. 1 is a schematic illustration of a switch assembly having a pushbutton with a display system constructed in accordance with the present invention.

The overall display system 32 is disposed in the pushbutton 24 of the switch assembly 20 (FIG. 1). The overall display system 32 includes both the incandescent display system 48 and the solid-state display system 58 (FIG. 2). The incandescent display system 48 and the solid-state display system 58 are disposed in the display housing 36 beneath the lens 42. The display housing 36 is molded from a single piece of electrically insulating polymeric material.

The incandescent display system 48 is mounted in a generally rectangular, open-ended, recess 74 formed in the right (as viewed in FIGS. 2 and 4) portion of the display housing 36. The solid-state display system 58 is disposed in a second rectangular, open-ended, recess 76 formed in the left (as viewed in FIGS. 2 and 4) portion of the display housing 36. Since the display housing 36 is formed of an electrically insulating polymeric material, the display housing electrically insulates the incandescent display system 48 disposed in the recess 74 from the solid-state display system 58 disposed in the recess 76.

The display housing 36 includes a linear wall 78 which extends between the incandescent display system 48 and the solid-state display system 58. Therefore, the incandescent display system 48 may be energized to illuminate only indicia 44 on the right portion of the lens 42 (FIG. 3). The solid-state display system 58 may be energized to illuminate only the indicia on the left portion of the lens 42. Of course, the incandescent display system 48 and the solid-state display system 58 may be simultaneously energized to illuminate both the left and right portions of the indicia 44.

The display housing 36 includes a rectangular array of side walls 82, 84, 86, and 88 (FIG. 4) which enclose the incandescent display system 48 and solid-state display system 58. The lens 42 is held on the display housing 36 by the lens cap 38 (FIG. 2) which has openings 90 and 92 which are engaged by projections 94 and 96 from the side walls 82 and 86. The lens cap 38 snaps in place and holds the lens 42 in position over the incandescent display system 48 and the solid state display system 58. A seal 100 extends around the outside of the display housing 36 and engages the inside of the outer housing 22 (FIG. 1). The seal may advantageously have the same construction as the seal disclosed in U.S. Pat. No. 5,420,386 issued May 30, 1995 to Reinelt and entitled "Switch Assembly".

Figure 5:
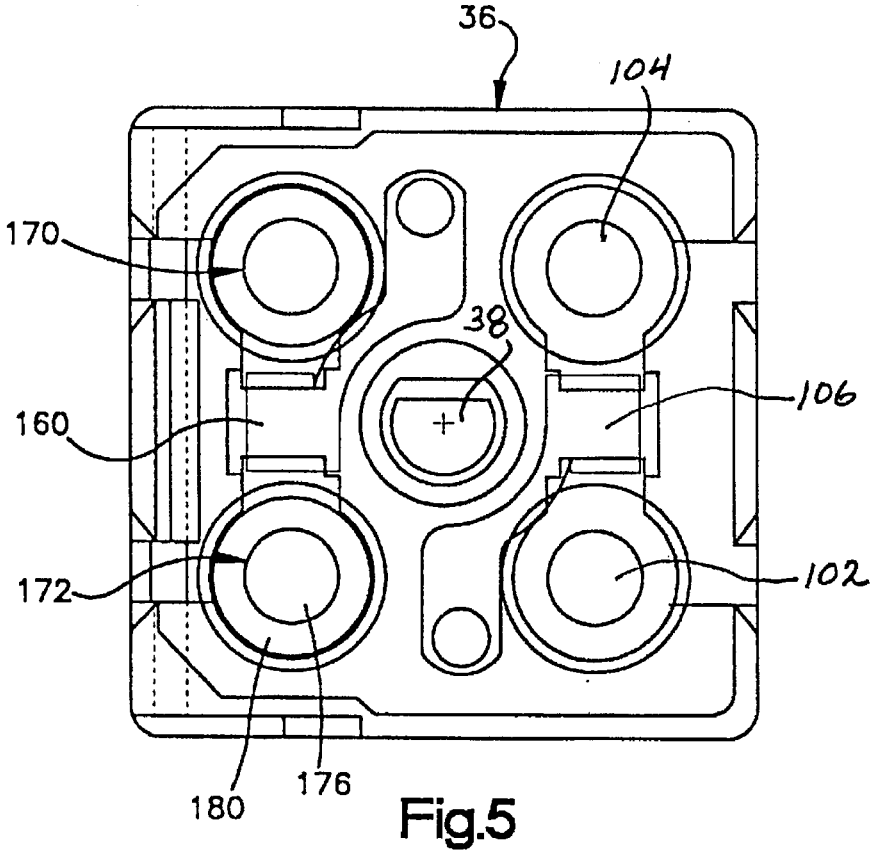
FIG. 5 is a plan view, taken generally along the line 5—5 of FIG. 2, further illustrating the construction of the display system.

The light sources 50 in the incandescent display system 48 (FIGS. 2 and 4) are connected with a positive side of a power supply through contacts 102 and 104 (FIG. 5). The light sources 50 in the incandescent display system are connected with a negative side of the power supply through a ground buss 106. The general construction of the incandescent display system 48 is known and will not be further described herein to avoid prolixity of description.

Solid-State Display System

Figure 9:
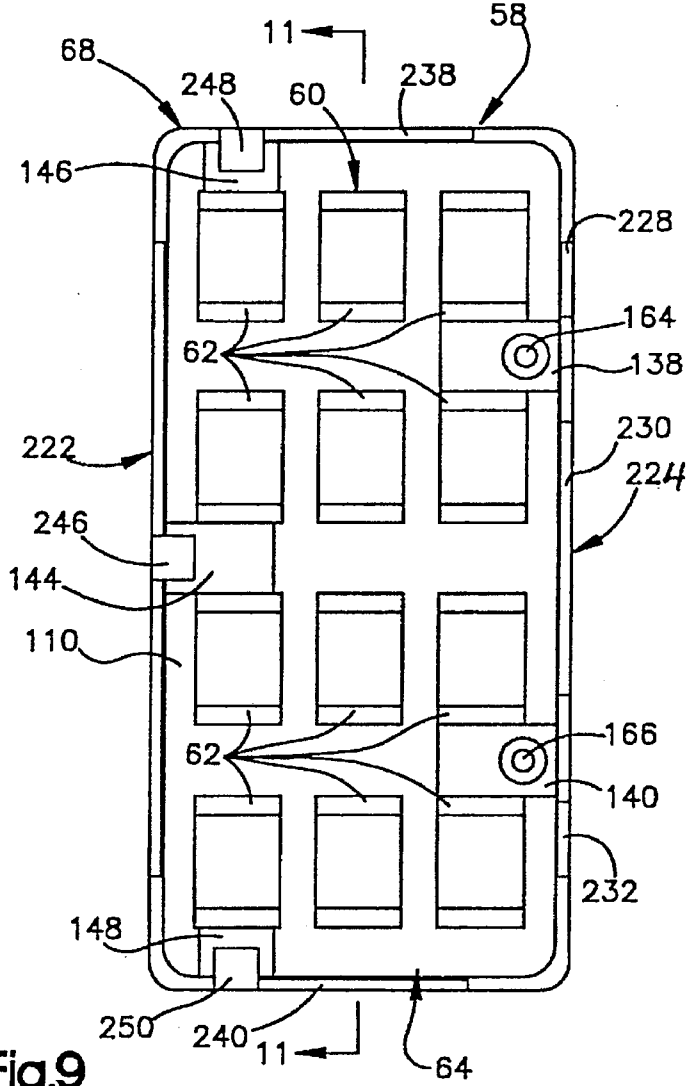
FIG. 9 is a plan view, taken generally along the line 9—9 of FIG. 8, illustrating the manner in which the circuit board Of FIG. 6 is disposed on a heat sink in the solid-state display system.
Figure 8:
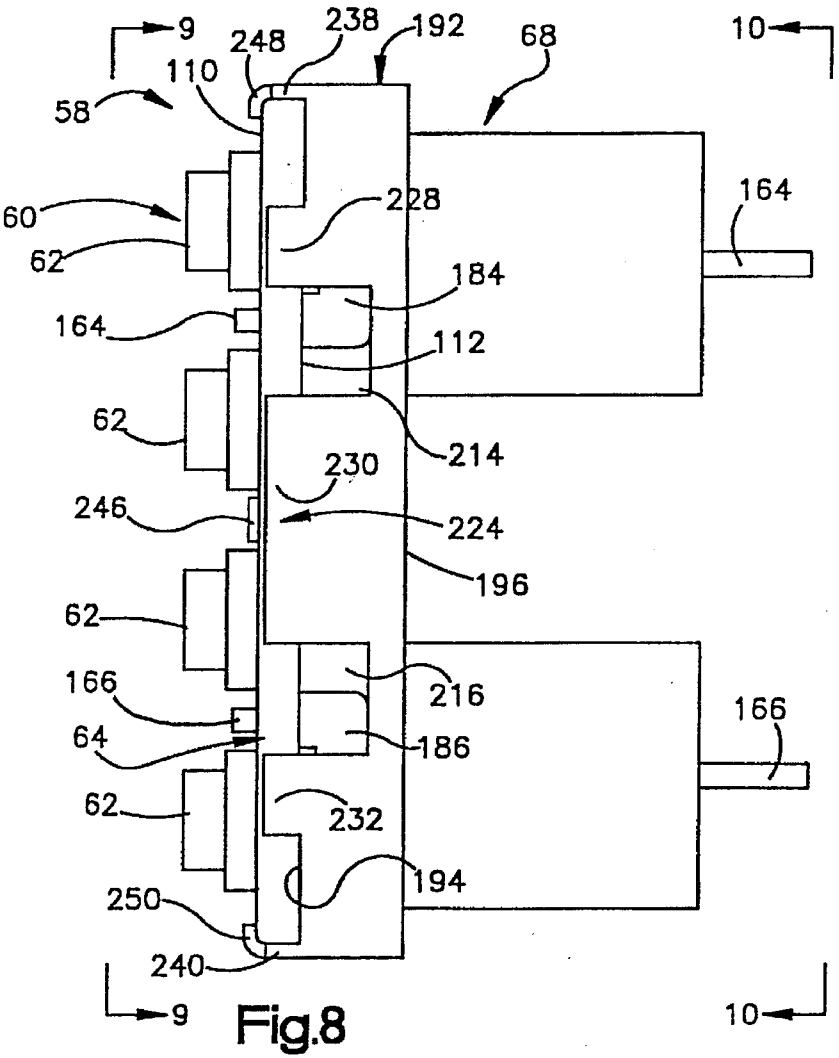
FIG. 8 is a side elevational view of a solid-state display system used in the display system of FIG. 2.
Figure 11:
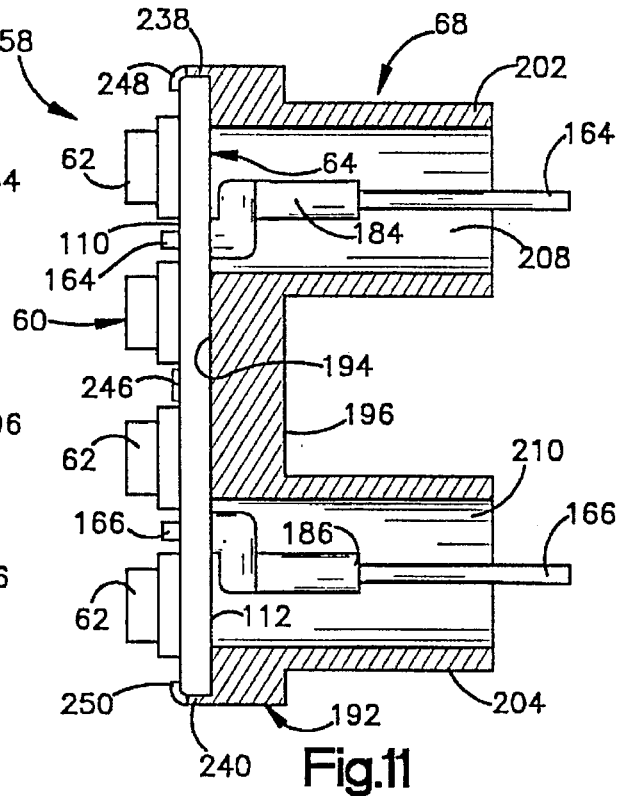
FIG. 11 is a sectional view, taken generally along the line 11—11 of FIG. 9, illustrating the manner in which conductors extend through the heat sink and are connected with the circuit board in the solid-state display system of FIG. 9.

The solid-state display system 58 illuminates the left (as viewed in FIG. 3) portion of the lens 42. The solid-state display system 58 includes the array 60 of light sources 62 disposed on the circuit board 64 (FIG. 6). The circuit board 64 has a flat rectangular outer major side 110 on which the array 60 of light emitting diodes 62 is disposed (FIGS. 6, 8 and 9). The circuit board 64 has a flat rectangular inner major side 112 which extends parallel to the outer side 110 (FIGS. 8 and 11).

The circuit board 64 has parallel side edge portions 114 and 116 and parallel end edge portions 118 and 120 (FIG. 6). The outer side 110 is connected with the inner side 112 (FIG. 11) by minor sides 124, 126, 128 and 130 (FIG. 6) which extend between the major sides.

In the illustrated embodiment of the invention, the circuit board 64 has a length of approximately ½ of an inch and a width of approximately ¼ of an inch. The relatively small size of the circuit board 64 increases the ability of the solid-state display system 58 to withstand vibration and to be utilized in systems where space is limited. Of course, the circuit board 64 could be of a different size and configuration if desired. The circuit board 64 may be formed with a fiberglass or paper base and epoxy resin in accordance with MEMA grade FR-4 specifications. Of course, the circuit board 64 could be formed of other materials if desired.

The circuit board 64 includes a plurality of metal (copper) conductors 134 (FIG. 6). The metal conductors 134 connect the light sources 62 with a pair of positive or power terminals 138 and 140 on the circuit board 64. The metal conductors 134 also connect the light sources 62 with a plurality of negative or ground terminals 144, 146 and 148 on the circuit board 64. The metal (copper) negative terminals 144, 146 and 148 are connected with the light sources 62 by the metal conductors 134. This enables both heat and electrical energy to be conducted from the light sources 62 to the negative terminals 144, 146 and 148 along metal flow paths formed by the conductors 134.

When switches 152 and 154 (FIG. 7) are closed, electrical energy is conducted through the light sources 62 to the negative terminals 144, 146 and 148 to energize the light sources. Although the light sources 62 are light emitting diodes, other known solid-state light sources could be used if desired. The light sources 62 are interconnected in such a manner that if only one of the switches 152 or 154 is closed, only one-half of the light sources are energized. This enables one-half of the array 60 of light sources 62 to be energized to illuminate either the upper or lower left quadrant (as viewed in FIG. 3) of the lens 42.

Figure 7:
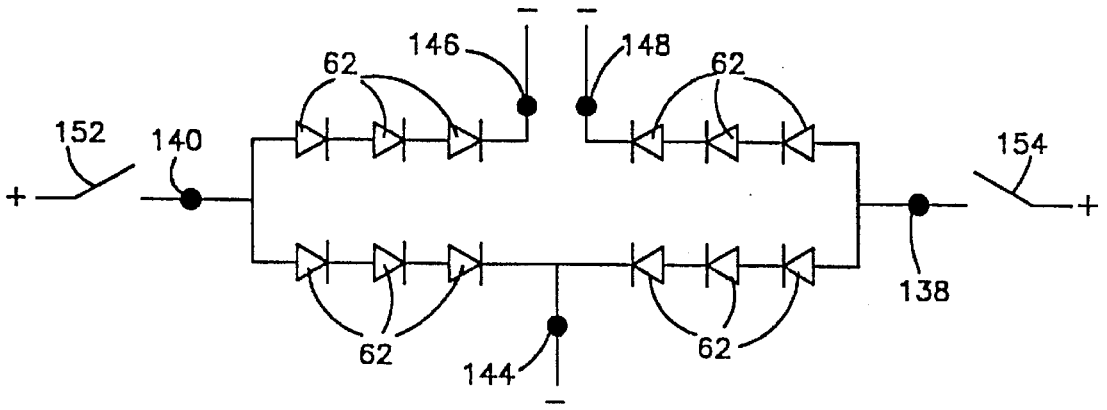
FIG. 7 is a schematic illustration depicting the manner in which light emitting diodes on the circuit board of FIG. 6 are electrically interconnected.

In the embodiment of the invention illustrated in FIG. 7, the light sources 62 are connected in a circuit having one particular configuration. It is contemplated that a greater or lesser number of light sources 62 could be connected in circuits having many different configurations.

The circuit board 64 is mounted on the heat sink 68 (FIGS. 8, 9 and 11). The heat sink 68 is itself mounted in the display housing 36 (FIG. 2). Therefore, the heat sink 68 positions the circuit board 64 relative to the display housing 36.

In addition, the heat sink 68 receives heat from the light emitting diodes 62 and circuit board 64 when the light emitting diodes are energized. This effectively cools the light emitting diodes 62 to reduce the maximum temperature of the light emitting diodes when they are energized. The heat sink 68 is formed of a material having favorable heat absorption and dissipation characteristics. To this end, the heat sink 68 is formed of metal.

The heat sink 68 cooperates with the circuit board 64 to maintain a substantially uniform temperature in the circuit board. By eliminating, or at least minimizing, the occurrence of relatively hot and/or cold areas in the circuit board 64, thermal stresses in the circuit board are minimized. The circuit board 64 is maintained at a uniform temperature due to a conducting of heat from the circuit board to the heat sink 68 and a dissipation of heat by the heat sink. Transfer of heat from the heat sink 68 is promoted by providing the heat sink with a relatively large, for the size of the heat sink, surface area.

The solid-state display system 58 has a relatively long service life and is capable of withstanding repeated variations in temperature through a wide range of temperatures. Thus, the solid-state display system 58 did not fail as a result of being subjected to a temperature test during which the solid-state display system was subjected to 350 cycles. In each of the cycles, the temperature changed through a range which extended between a low temperature of −55° C. and a high temperature of +85° C. During the temperature test, the light emitting diodes 62 were energized at various temperatures in the range of temperatures. When a known ceramic mounted display system was subjected to the same temperature cycles, the light emitting diodes in the known ceramic mounted display system failed before they had been subjected to 19 cycles of temperature variation of from −55° C. to +85° C.

In accordance with one of the features of the invention, the heat sink 68 forms a portion of a circuit which conducts electrical energy to energize the light emitting diodes 62. Thus, the heat sink 68 is connected with the negative or ground terminals 144, 146 and 148 (FIGS. 6 and 7) on the circuit board 64. The heat sink 68 is itself connected with a negative side of a power supply by copper buss terminals 160 (FIG. 5) and conductors in the housing 22 of the switch assembly 20. Although the heat sink 68 is connected with the negative terminals 144, 146 and 148 on the circuit board 64 (FIG. 6), it is contemplated that the heat sink could be connected with the positive or power terminals 138 and 140 if desired.

Figure 10:
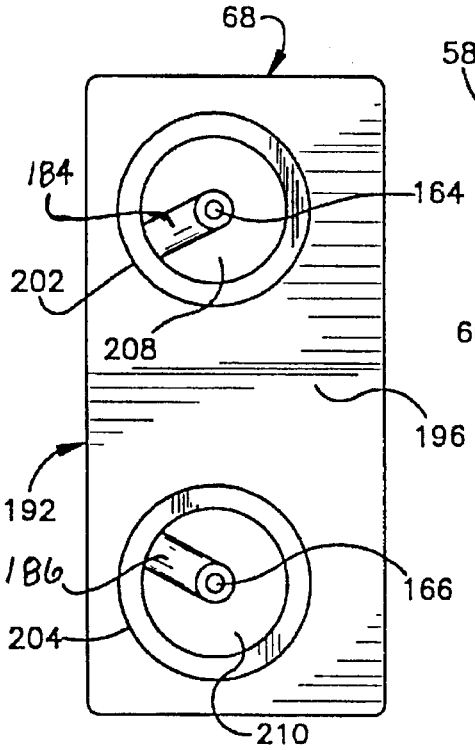
FIG. 10 is a plan view, taken generally along the line 10—10 of FIG. 8, further illustrating the construction of the solid-state display system.

In the illustrated embodiment of the invention, the power terminals 138 and 140 (FIG. 6) on the circuit board 64 are connected with a source of electrical energy through conductors 164 and 166 (FIGS. 8, 10 and 11). The conductors 164 and 166 extends through the heat sink 68. The conductors 164 and 166 are connected with the power terminals 138 and 140 on the circuit board 60 (FIGS. 6, 7 and 9).

Contacts 170 and 172 (FIGS. 2 and 5) are connected with the ends of the conductors 164 and 166. The contact 172 includes a metal contact button 176 (FIG. 2) which is secured directly to the end of the conductor 166. A cylindrical metal contact sleeve 178 is secured to the circular contact button 176 and extends into a tubular insulator 180. The insulator 180 is disposed between the heat sink 68 and the contact sleeve 178. The insulator 180 is also disposed between the heat sink 68 and the contact button 176.

Although only the structure of the contact 172 is illustrated in FIG. 2, it should be understood that the contact 170 has the same construction as the contact 172. Inner portions of the conductors 164 and 166 are enclosed by flexible insulating sleeves 184 and 186 (FIGS. 10 and 11) which prevent engagement of the conductors 164 and 166 with the metal heat sink 68. When the pushbutton 24 is manually actuated, the contacts 170 and 172 and the ground buss 160 move into engagement with contacts disposed in the outer housing 22 and connected with either a positive or a negative side of a power supply.

Heat Sink

The metal heat sink 68 (FIGS. 10–15) positions the circuit board 64 in the display housing 36 (FIG. 2) and forms a portion of the circuit which conducts electrical energy to energize the array 60 of light sources (FIGS. 9 and 11). In addition, the metal heat sink 68 absorbs heat from the light sources 62 and circuit board 64 when the light sources are energized. By absorbing heat which is generated when the light sources 62 are energized, the heat sink 68 tends to minimize the maximum heat to which the light sources are exposed when the solid-state display system 58 is in an environment which is at any one of the temperatures within the range of temperatures from −55° C. to +85° C. In addition, the heat sink 68 promotes the obtaining of a uniform temperature throughout the extent of the circuit board 64.

Although the heat sink 68 could be formed of many different materials, in the specific embodiment of the heat sink illustrated in FIGS. 10–15, the heat sink is formed of a single piece of brass (UNS C36000) alloy 360, ½ hard, QQ-B-626. The brass heat sink is plated with gold to a minimum thickness of 0.000050 inches to increase the electrical conductivity of the heat sink. The foregoing specific materials for the heat sink 68 have been set forth herein for purposes of clarity of description. It is contemplated that the heat sink 68 could be formed of many different materials. However, it is presently preferred to form the heat sink 68 of metal to enable the heat sink to absorb and dissipate a substantial amount of heat energy and to conduct electrical energy when the light sources 62 in the array 60 are energized.

The heat sink 68 includes a rectangular body portion 192 (FIGS. 10–15). The rectangular body portion 192 has a flat outer side surface 194 which is engaged by the flat inner side 112 (FIG. 11) of the circuit board 64. The outer side surface 194 on the heat sink 68 is coextensive with the inner side 112 of the circuit board 64. In addition, the heat sink 68 has a flat inner side surface 196 which engages the electrically insulating material of the display housing 36 (FIG. 2).

The heat sink 68 (FIGS. 10–15) has a pair of cylindrical tubular mounting sections 202 and 204 (FIGS. 10, 11 and 13–15). The tubular mounting sections 202 and 204 are integrally formed as one piece with the body portion 192. The cylindrical sections 202 and 204 engage cylindrical openings in the display housing 36 (FIG. 2) to further position the heat sink 68 relative to the display housing. The tubular mounting sections 202 and 204 cooperate with the polymeric material of the display housing 36 to retain the heat sink 68 against movement relative to the display housing. The tubular mounting sections 202 and 204 have a relatively large surface area to promote transfer of heat from the heat sink 68.

The tubular sections 202 and 204 have cylindrical passages 208 and 210 (FIGS. 10–12 and 15). The passages 208 and 210 extend through the heat sink 68. A pair of rectangular branch passages 214 and 216 (FIGS. 12 and 13) extend transversely from the cylindrical passages 208 and 210. The conductors 164 and 166 extend through the cylindrical passages 208 and 210 into the branch passages 214 and 216.

The branch passages 214 and 216 extend to locations directly beneath the power terminals 138 and 140 (FIG. 6) on the circuit board 64 (FIG. 11). This enables the conductors 164 and 166 to extend through the passages 208 and 210 in the tubular sections 202 and 204 and through the branch passages 214 and 216 (FIGS. 8 and 12) formed in the body portion 192 to engage the power terminals 138 and 140 (FIG. 9) on the circuit board 64. End portions of the conductors 164 and 166 are soldered to the terminals 138 and 140. The insulating sleeves 184 and 186 on the conductors 164 and 166 insulate the conductors so that they do not make an electrical connection with the heat sink 68.

The heat sink 68 positions the circuit board 64 in the solid-state display system 58 and in the display housing 36. The heat sink 68 has parallel longitudinal side walls 222 and 224 (FIGS. 12–15) which are integrally formed as one piece with the body portion 192. The parallel linear side walls 222 and 224 engage the longitudinally extending minor sides 124 and 128 (FIG. 6) of the circuit board 64 (FIG. 9) to position the circuit board relative to the body portion 192 of the heat sink 68.

Figure 12:
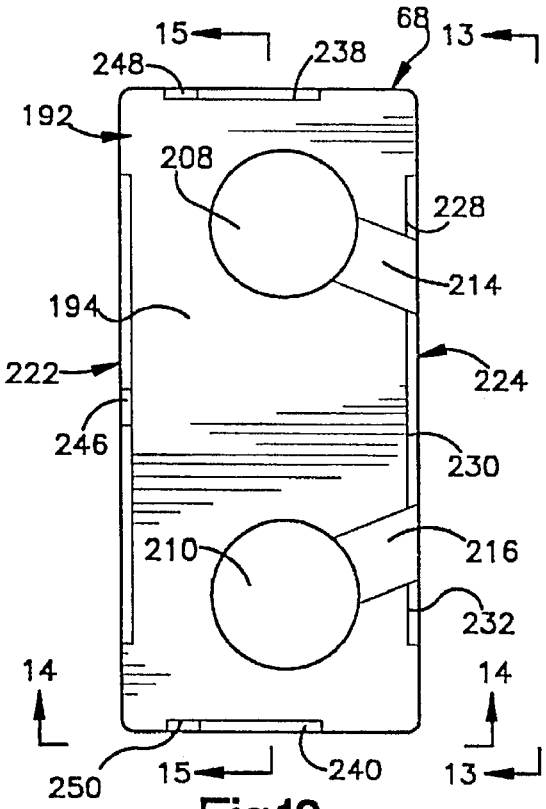
FIG. 12 is a top plan view of the heat sink of FIG. 11 prior to installation of the circuit board.
Figure 13:
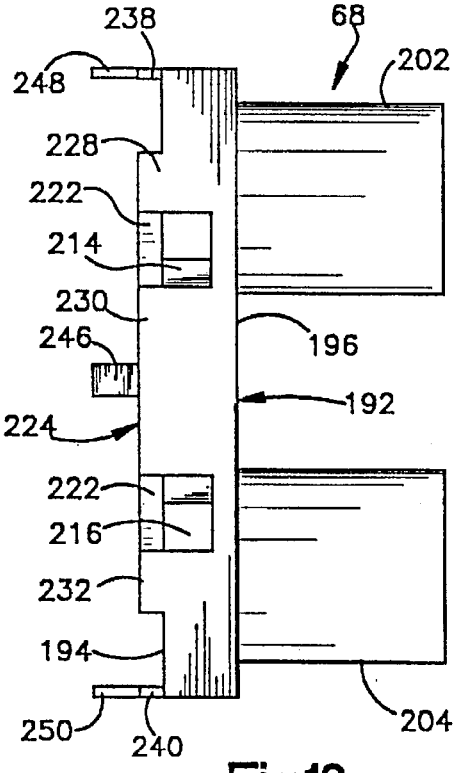
FIG. 13 is a side elevational view, taken generally along the line 13—13 of FIG. 12, further illustrating the construction of the heat sink.
Figure 14:
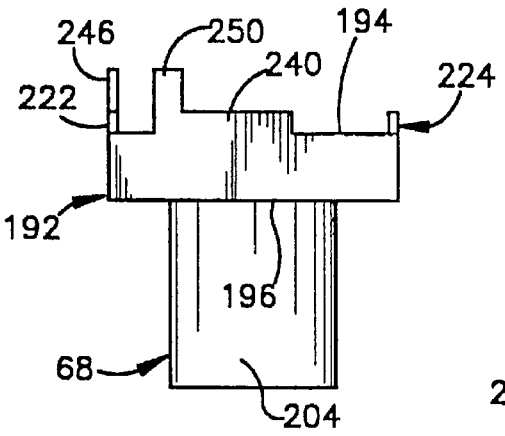
FIG. 14 is an end elevational view, taken generally along the line 14—14 of FIG. 12, further illustrating the construction of the heat sink.

The longitudinal side wall 222 (FIGS. 12, 14 and 15) extends outward from the flat major side surface 194 of the body portion 192 and is formed as a continuous wall. The side wall 224 also projects outward from the flat major side surface 194 of the body portion 192. However, the side wall 224 is divided into three segments 228, 230 and 232 by the branch passages 214 and 216 (FIGS. 8, 12 and 14).

The heat sink 68 has a pair of parallel end walls 238 and 240 (FIGS. 10–15). The end walls 238 and 240 engage minor sides 126 and 130 (FIG. 6) at opposite ends of the circuit board 64 to position the circuit board relative to the heat sink 68 (FIGS. 8 and 9). The end walls 238 and 240 are integrally formed as one piece with the body portion 192 of the heat sink 68.

The end walls 238 and 240 extend perpendicular to the side walls 222 and 224 and to the outer major side surface 194 of the heat sink 68. The side walls 222 and 224 and the end walls 238 and 240 cooperate with the major side surface 194 on the body portion 192 of the heat sink 68 to form a rectangular recess in which the circuit board 64 is received (FIGS. 8, 9 and 11). The rectangular recess formed by the side walls 222 and 224 and end walls 238 and 240 and side surface 194 of the heat sink 68 has a width and length which is the same as the width and length of the rectangular circuit board 64.

In accordance with another feature of the present invention, retaining tabs 246, 248 and 250 (FIGS. 12–15) are provided on the heat sink 68. The retaining tabs 246, 248 and 250 clamp the circuit board 64 against the body portion 196 of the heat sink (FIGS. 8, 9 and 11). The retaining tabs 246,248 and 250 electrically interconnect the heat sink 68 and circuit board 64. In addition, the retaining tabs 246, 248 and 250 conduct heat from the circuit board 64.

As initially formed, the retaining tabs 246, 248 and 250 extend outward from and are integrally formed as one piece with the body portion 192 of the heat sink 68. In the illustrated embodiment of the invention, the retaining tabs 246, 248 and 250 extend outward from the side wall 222 and the end walls 238 and 240 (FIGS. 12–15). Although there are three retaining tabs in the illustrated embodiment of the invention, a greater or lesser number of retaining tabs could be used if desired.

Figure 15:
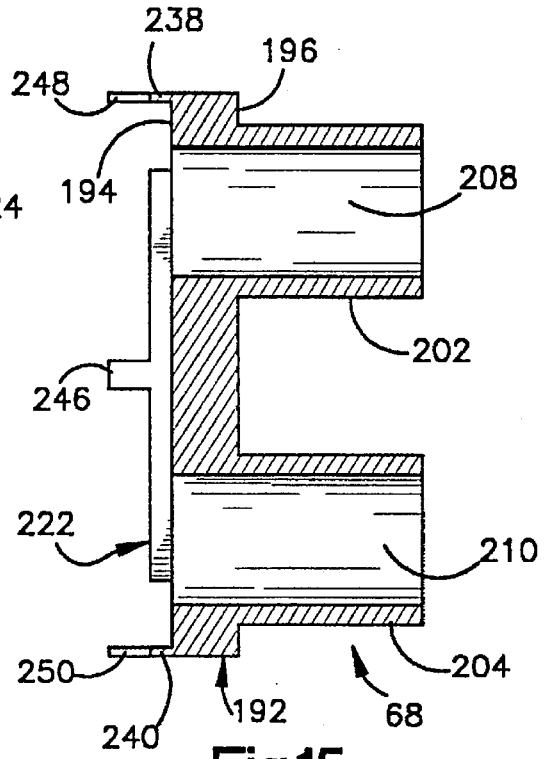
FIG. 15 is a sectional view, taken generally along the line 15—15 of FIG. 12, further illustrating the construction of the heat sink.

Once the circuit board 64 has been positioned with the inner side surface 112 of the circuit board in flat abutting engagement with the outer side surface 194 of the body portion 192 of the heat sink 68, the metal retaining tabs 246, 248 and 250 are bent over from the extended position shown in FIGS. 14 and 15 to the retaining position shown in FIGS. 8 and 9. When the retaining tabs 246, 248 and 250 are in the retaining position shown in FIGS. 8 and 9, the retaining tabs press against the circuit board 64 and clamp the circuit board against the outer major side 194 of the body portion 192 of the heat sink 68.

The metal retaining tabs 246, 248 and 250 have side surfaces which apply force against the outer side 110 of the circuit board 64. The force applied against the outer side 110 of the circuit board 64 by the retaining tabs 246, 248 and 250 presses the inner side 112 of the circuit board 64 against the flat outer side 194 (FIGS. 11 and 12) of the heat sink 68. By pressing the circuit board 64 against the body portion 192 of the heat sink 68, the retaining tabs 246, 248 and 250 promote heat transfer between the circuit board and the heat sink 68. In addition, the retaining tabs 246, 248 and 250 hold the circuit board 64 against movement relative to the heat sink 68.

The metal retaining tabs 246, 248 and 250 engage the metal negative terminals 144, 146 and 148 (FIGS. 6 and 9) on the circuit board 64. By engaging the negative terminals 144, 146 and 148 on the circuit board 64, the retaining tabs 246, 248 and 250 electrically interconnect the circuit board 64 and heat sink 68 (FIG. 9). The retaining tabs 246, 248 and 250 are advantageously soldered to the negative terminals 144, 146 and 148 on the circuit board 64. The gold plating on the outside of the heat sink 68 provides minimal resistance to the conduction of electrical energy by the heat sink when the array 60 of light sources 62 is energized. The heat sink 68 is itself connected with a negative side of a power supply through the buss terminal 160 (FIG. 5) on the end of the display housing 36.

Since the retaining tabs engage the metal ground terminals 144, 146 and 148, there is a direct metal-to-metal heat conduction path between the circuit board 64 and the heat sink 68. This metal-to-metal heat flow path promotes a flow of heat from the light sources 62 to the heat sink 68 when the light sources are energized. Thus, heat is conducted away from the light sources 62 through the metal conductors 134 (FIG. 6) to the heat sink 68. This enables the metal conductors 134 and metal terminals 144, 146 and 148 on the circuit board 64 and the metal retaining tabs 246, 248 and 250 to be used to conduct both heat and electrical energy when the light sources 62 are energized.

Second Embodiment

Figure 16:
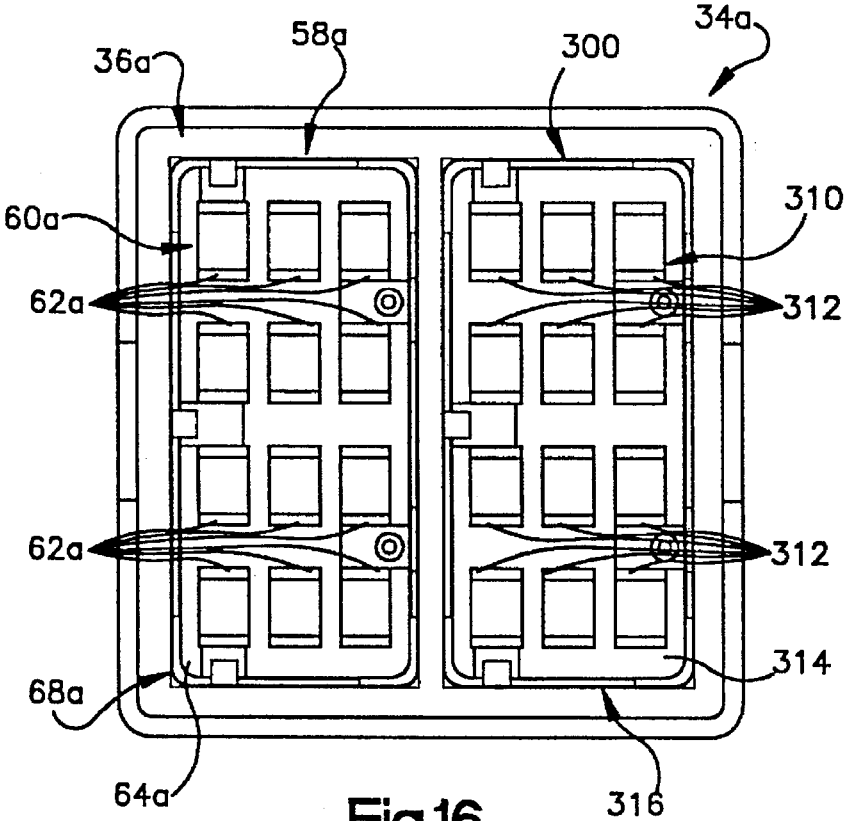
FIG. 16 is a plan view of a portion of a second embodiment of the display system.

In the embodiment of the invention illustrated in FIGS. 1–15, the overall display system 32 (FIGS. 2 and 4) includes an incandescent display system 48 and a solid-state display system 58. In the embodiment of the invention illustrated in FIG. 16, the overall display system does not include an incandescent display system but rather includes a plurality of solid-state display systems. Since the embodiment of the invention illustrated in FIG. 16 is generally similar to the embodiment of the invention illustrated in FIGS. 1–15, similar numerals will utilized to designate similar components, the suffix letter "a" being associated with the numerals of FIG. 16 to avoid confusion.

An overall display system 34*a* includes a display housing 36*a* which contains a solid-state display system 58*a*. In addition, the display housing 36*a* contains a second solid-state display system 300.

The solid-state display system 58*a* has the same construction as the solid-state display system 58 of FIGS. 1–15. Thus, the solid-state display system 58*a* of FIG. 16 includes an array 60*a* of light sources 62*a*. The light sources 62*a* are disposed on a circuit board 64*a*. The circuit board 64*a* is connected with a heat sink 68*a*.

The solid-state display system 300 has the same construction as the solid-state display system 58*a*. Thus, the solid-state display system 300 includes an array 310 of light sources 312. The light sources 312 are disposed on a circuit board 314. The circuit board 314 is connected with a heat sink 316.

The heat sink 316 has the same construction as the heat sink 68 of FIGS. 12–15. The heat sink 316 positions the circuit board 314 relative to the display housing 36*a*. In addition, the heat sink 316 conducts heat away from the circuit board 314 and light sources 312 when the light sources are energized. The heat sink 316 forms a portion of an electrical circuit which conducts electrical energy to energize the light sources 312.

In the embodiment of the invention illustrated in FIG. 16, the overall display system 34*a* includes a pair of solid-state display systems 58*a* and 300. It is contemplated that the overall display system 34*a* could contain a greater or lesser number of solid-state display systems if desired, For example, the overall display system 34*a* could contain six solid-state display systems. The solid-state display systems do not have to be identical. Thus, the light sources in each of the solid-state display systems could be interconnected in electrical circuits having different configurations.

Conclusion

In view of the foregoing description, it is apparent that the present invention provides a new and improved display system 58 to provide information to an observer. The improved display system 58 does not fail after being subjected to a temperature test which includes 350 cycles in which the temperature varies from −55° C. to +85° C. During the temperature test, light sources in the display system 58 are energized at various temperatures. The display system 58 is advantageously used in a pushbutton 24 of a switch assembly 20.

The display system 58 includes a heat sink 68 which is disposed in a display housing 36. A circuit board 64 is mounted on the heat sink 68. Light sources 62 are mounted on the circuit board 64. The light sources 62 are electrically energizeable to produce light which is transmitted to an observer and heat which is transmitted to the heat sink 68. The light sources 62 are energized by electrical energy which is conducted through a circuit which includes the heat sink 68.

The heat sink 68 has a plurality of wall sections 222, 224, 238 and 240 which extend outward from a body portion 192 of the heat sink. The wall sections 222, 224, 238 and 240 engage the circuit board 64 to position the circuit board relative to the body portion 192 of the heat sink 68. The heat sink 68 has a plurality of retaining tabs 246, 248 and 250 which engage the circuit board 64 to press the circuit board against the heat sink and to hold the circuit board against movement relative to the heat sink. The retaining tabs engage conductors 144, 146 and 148 on the circuit board 64 to electrically interconnect the heat sink 68 and light sources 62.

Having described the invention, the following is claimed:

1. A display system to provide information to an observer, said display system comprising a heat sink having a body portion formed of an electrically conductive material, a circuit board having a first major side disposed in engagement with said body portion of said heat sink and a second major side which faces away from said first major side, and a plurality of light sources mounted on said second major side of said circuit board and electrically energizeable to produce light which is transmitted to the observer and to produce heat which is transmitted to said heat sink, said circuit board includes an electrical conductor connected with at least one of said light sources, said electrical conductor being connected with said heat sink to enable said one of said light sources to be energized by electrical energy conducted through the electrically conductive material of said heat sink and said electrical conductor.

2. A display system as set forth in claim 1 wherein said heat sink includes a retainer portion which extends outward from said body portion of said heat sink, said retainer portion of said heat sink including surface means for engaging said electrical conductor to electrically interconnect said electrical conductor and said heat sink and for applying force against said circuit board to press said first major side of said circuit board against said body portion of said heat sink.

3. A display system as set forth in claim 1 wherein said heat sink includes a tubular portion which extends from said body portion of said heat sink in a direction away from said circuit board, said display system further including a conductor which extends through said tubular portion of said heat sink, said conductor being connected with said circuit board and being electrically connected with at least one of said light sources of said plurality of light sources.

4. A display system as set forth in claim 1 wherein said circuit board includes a plurality of minor sides which extend between said first and second major sides of said circuit board, said heat sink including a plurality of projections which are disposed in engagement with said minor sides of said circuit board to block movement of said circuit board relative to said heat sink.

5. A display system as set forth in claim 1 wherein said heat sink includes a plurality of retainer tabs which extend from said body portion of said heat sink, each of said retainer tabs being disposed in engagement with said second major side of said circuit board and being effective to press said first major side of said circuit board against said body portion of said heat sink.

6. A display system as set forth in claim 1 wherein said body portion of said heat sink includes a flat side surface area which is disposed in abutting engagement with said first major side of said circuit board and a passage which extends away from said flat side surface area of said heat sink, said display system further including an electrical conductor which extends through said passage to said first major side of said circuit board, a body of electrically insulating material disposed between a portion of said conductor and a side surface of said passage, and a contact element connected with an end portion of said conductor and disposed in engagement with said body of electrically insulating material.

7. A display system as set forth in claim 1 wherein said first major side of said circuit board has a generally rectangular configuration, said body portion of said heat sink having a generally rectangular side which is at least coextensive with said first major side of said circuit board and is disposed in engagement with said first major side of said circuit board, said heat sink having a plurality of side wall sections which extend outward of said generally rectangular side of said body portion of said heat sink and are disposed in a rectangular array which extends around a peripheral edge portion of said circuit board, and a plurality of retaining tabs which extend from said side wall sections and are disposed in engagement with said second major side of said circuit board to press said first major side of said circuit board against said generally rectangular side of said body portion of said heat sink.

8. A display system to provide information to an observer, said display system comprising a heat sink having a body portion with first and second sides, a plurality of side wall sections extending outward from said first side of said body portion, and a plurality of retaining tabs connected with said body portion, a circuit board having a first major side disposed in engagement with said first side of said body portion of said heat sink, a second major side opposite from said first major side, and a plurality of minor sides extending between said first and second major sides of said circuit board, each of said side wall sections of said heat sink being disposed in engagement with one of said minor sides of said circuit board to block movement of said circuit board relative to said heat sink, each of said retaining tabs being disposed in engagement with said second major side of said circuit board to retain said first major side of said circuit board in engagement with said first side of said body portion of said heat sink, a plurality of light sources mounted on said second major side of said circuit board and electrically energizeable to produce light which is transmitted to the observer and to produce heat which is transmitted to said heat sink, said heat sink including a tubular section which extends outward from said second side of body portion, and an electrical conductor which extends through said tubular section and said body portion of said heat sink to said second side of said circuit board.

9. A display system as set forth in claim 8 wherein said heat sink further including a second tubular section which extends outward from said second side of said body portion, said display system further including a second electrical conductor which extends through said second tubular section and said body portion of said heat sink to said second side of said circuit board.

10. A display system as set forth in claim 8 wherein said circuit board includes an electrical conductor connected with at least one of said light sources, at least one of said retaining tabs being disposed in engagement with said electrical conductor to electrically interconnect said heat sink and said one of said light sources to enable said one of said light sources to be energized by electrical energy conducted through said heat sink and said electrical conductor.

11. A switch assembly comprising a housing, a switch disposed within said housing and operable between open and closed conditions, a pushbutton connected with said housing and manually movable relative to said housing to effect operation of said switch between the open and closed conditions, said pushbutton including a lens, a metal heat sink connected with said lens, a circuit board mounted on said metal heat sink, said circuit board having an inner side which engages said metal heat sink and an outer side which faces toward said lens, a plurality of light sources mounted on said outer side of said circuit board and energizeable to produce light which is transmitted through said lens and heat which is transmitted to said metal heat sink, and circuit means for conducting electrical energy to energize said light sources, said metal heat sink forming a portion of said circuit means so that electrical energy is conducted through metal of said metal heat sink when said light sources are energized.

12. A switch assembly as set forth in claim 11 wherein said metal heat sink has a body portion with a flat side surface area which is disposed in abutting engagement with said inner side of said circuit board.

13. A switch assembly as set forth in claim 11 wherein said metal heat sink includes means for defining a passage which extends through said metal heat sink, said display system further including a conductor which extends through said passage in said metal heat sink and is electrically connected with at least one of said light sources.

14. A switch assembly as set forth in claim 11 wherein said circuit board includes an electrical conductor disposed adjacent to said outer side of said circuit board and electrically connected with one of said light sources of said plurality of light sources, said metal heat sink having a portion which engages said electrical conductor to enable electrical energy and heat to be conducted between said electrical conductor and said metal heat sink, said portion of said metal heat sink which engages said electrical conductor includes surface means for applying force against said circuit board to press said inner side of said circuit board against a flat side surface area on a body portion of said metal heat sink.

15. A switch assembly as set forth in claim 11 wherein said circuit board includes a plurality of minor sides which extend between said inner and outer sides, said metal heat sink including a plurality of side walls each of which extends outward from said metal heat sink and is disposed in engagement with one of said minor sides of said circuit board, said metal heat sink having a flat surface area which extends between said side walls and engages said inner side of said circuit board.

16. A switch assembly as set forth in claim 11 wherein said push button includes a base portion which is connected with said lens, said metal heat sink having a plurality of metal mounting sections which extend outward from a side of said heat sink opposite from said circuit board, said mounting sections being disposed in engagement with said base portion of said push button to retain said metal heat sink against movement relative to said base portion of said push button.

17. A switch assembly as set forth in claim 11 wherein said metal heat sink includes a plurality of tubular sections, said display system further includes a plurality of electrical conductors which extend through said tubular sections and are electrically connected with at least some of said light sources of said plurality of light sources.

18. A switch assembly as set forth in claim 17 wherein said metal heat sink includes a body portion having a first side which is disposed in engagement with said inner surface of said circuit board, said tubular sections extend outward from a side of said body portion opposite from the side of said body portion which is disposed in engagement with said circuit board.

19. A switch assembly as set forth in claim 17 further including a plurality of bodies of electrically nonconductive material, each of said bodies of electrically nonconductive material being at least partially disposed in one of said tubular sections to electrically insulate one of said conductors from said one of said tubular sections.

20. A switch assembly as set forth in claim 11 wherein said metal heat sink has a plurality of projections which are disposed in engagement with said circuit board to block movement of said circuit board relative to said metal heat sink.

21. A switch assembly as set forth in claim 11 wherein said metal heat sink includes a plurality of retainer tabs, each of said retainer tabs being disposed in engagement with said outer side of said circuit board and being effective to press said inner side of said circuit board against said metal heat sink.

22. A switch assembly as set forth in claim 11 wherein said metal heat sink includes a flat side surface area which is disposed in abutting engagement with said inner side of said circuit board and a passage which extends away from said flat side surface area of said metal heat sink, said switch assembly further including an electrical conductor which extends through said passage to said inner side of said circuit board, and a body of electrically insulating material disposed between a portion of said conductor and a side surface of said passage.

23. A switch assembly as set forth in claim 11 wherein said inner side of said circuit board has a generally rectangular configuration, said metal heat sink having a generally rectangular outer side which is at least coextensive with said inner side of said circuit board and is disposed in engagement with said inner side of said circuit board, said metal heat sink having a plurality of side wall sections which extend outward of said generally rectangular outer side of said metal heat sink and are disposed in a rectangular array which extends around a peripheral edge portion of said circuit board, and a plurality of retaining tabs which extend from said side wall sections and are disposed in engagement with said outer side of said circuit board to press said inner side of said circuit board against said generally rectangular outer side of said metal heat sink.

24. A display system to provide information to an observer, said display system comprising a base having surfaces which at least partially defines a recess having an open end, a lens connected with said base and extending across the open end of said recess, a metal heat sink disposed in said recess, a circuit board mounted on said metal heat sink, a plurality of light sources mounted on said circuit board and energizeable to produce light which is transmitted through said lens to the observer and heat which is transmitted to said metal heat sink, and circuit means for conducting electrical energy to energize said light sources, said metal heat sink forming a portion of said circuit means so that electrical energy is conducted through metal of said metal heat sink when said light sources are energized.

25. A display system as set forth in claim 24 wherein said circuit board has a first major side surface on which said plurality of light sources are mounted and a second major side surface opposite from said first major side surface, said metal heat sink including a body portion having a flat side surface area which is disposed in abutting engagement with said second major side surface of said circuit board and an outer side surface area which is disposed in engagement with said surfaces which at least partially define a recess in said base.

26. A display system as set forth in claim 24 wherein said metal heat sink includes means for defining a passage which extends through said metal heat sink, said circuit means further including a conductor which extends through said passage in said metal heat sink and is electrically connected with at least one of said light sources, said one of said light sources being electrically connected with the metal of said metal heat sink to enable electrical energy to be conducted between said conductor and metal heat sink through said one of said light sources.

27. A display system as set forth in claim 24 wherein said circuit board includes an electrical conductor disposed adjacent to a first major side surface of said circuit board and electrically connected with one of said light sources of said plurality of light sources, said metal heat sink having a portion which engages said electrical conductor to enable electrical energy and heat to be conducted between said electrical conductor and said metal heat sink, said portion of said metal heat sink which engages said electrical conductor includes surface means for applying force against said circuit board to press said circuit board against said metal heat sink.

28. A display system as set forth in claim 24 wherein said metal heat sink includes a body portion on which said circuit board is mounted and a plurality of metal mounting sections which extend outward from a side of said body portion opposite from said circuit board, said mounting sections being disposed in engagement with said base to retain said metal heat sink against movement relative to said base.

29. A display system as set forth in claim 24 wherein said metal heat sink includes a plurality of tubular sections, said circuit means further includes a plurality of electrical conductors which extend through said tubular sections of said heat sink and are electrically connected with said light sources of said plurality of light sources, said light sources of said plurality of light sources being electrically connected with the metal of said metal heat sink to enable electrical energy to be conducted between said electrical conductors and metal heat sink through said plurality of light sources.

30. A display system as set forth in claim 29 wherein said metal heat sink includes a body portion having a first side which is disposed in engagement with said circuit board, said tubular sections extend outward from a side of said body section opposite from the side of said body section which is disposed in engagement with said circuit board.

31. A display system as set forth in claim 29 further including a plurality of bodies of electrically nonconductive material, each of said bodies of electrically nonconductive material being at least partially disposed in one of said tubular sections to electrically insulate one of said conductors from said one of said tubular sections.

32. A display system to provide information to an observer, said display system comprising a heat sink having a body portion and a retainer tab which extends from said body portion of said heat sink, a circuit board having a first major side disposed in engagement with said body portion of said heat sink and a second major side which faces away from said first major side, and a plurality of light sources mounted on said second major side of said circuit board and electrically energizeable to produce light which is transmitted to the observer and to produce heat which is transmitted to said heat sink, said circuit board includes an electrical conductor disposed on said second major side of said circuit board, said retainer tab having surface means which applies force against said conductor to press said first major side of said circuit board against said body portion of said heat sink and through which said heat sink is connected with said conductor to enable electrical and thermal energy to be conducted between said body portion of said heat sink and said conductor through said retainer tab.

33. An apparatus as set forth in claim 32 further including a base, said heat sink including first and second tubular mounting sections which extend from said body portion of said heat sink in a direction away from said circuit board into said base, a first electrical circuit component which extends through said first tubular mounting section and said body portion of said heat sink to said circuit board, and a second electrical circuit component which extends through said second tubular mounting section and said body portion of said heat sink to said circuit board.

34. A display system as set forth in claim 33 wherein said first electrical circuit component is connected with said electrical conductor through at least one of said light sources to enable electrical energy for energizing said one light source of said plurality of light sources to be conducted between said retainer tab of said heat sink and said first electrical circuit component through said electrical conductor and said one light source of said plurality of light sources.

* * * * *